US008431874B2

(12) United States Patent
Oh et al.

(10) Patent No.: US 8,431,874 B2
(45) Date of Patent: Apr. 30, 2013

(54) HIGH-CAPACITY PTC HEATER

(75) Inventors: Man Ju Oh, Ulsan (KR); Duck Chae Jun, Seongnam-si (KR); Tae Soo Sung, Asan-si (KR)

(73) Assignees: Hyundai Motor Company, Seoul (KR); Kia Motors Corporation, Seoul (KR); Modine Korea, LLC, Asan-Si (KR)

( * ) Notice: Subject to any disclaimer, the term of this patent is extended or adjusted under 35 U.S.C. 154(b) by 768 days.

(21) Appl. No.: 12/605,724

(22) Filed: Oct. 26, 2009

(65) Prior Publication Data

US 2010/0122978 A1 May 20, 2010

(30) Foreign Application Priority Data

Nov. 17, 2008 (KR) ..... 10-2008-0114251

(51) Int. Cl.
*H05B 3/06* (2006.01)

(52) U.S. Cl.
USPC ..... 219/540; 219/536; 219/546; 219/548

(58) Field of Classification Search ..... 219/540, 219/536, 546, 548
See application file for complete search history.

(56) References Cited

U.S. PATENT DOCUMENTS

| | | | | |
|---|---|---|---|---|
| 7,064,301 | B2 * | 6/2006 | Han et al. | 219/540 |
| 2003/0169117 | A1 * | 9/2003 | Flynn et al. | 331/66 |
| 2007/0295706 | A1 * | 12/2007 | Brun et al. | 219/202 |

FOREIGN PATENT DOCUMENTS

| | | | |
|---|---|---|---|
| JP | 5-21134 | A | 1/1993 |
| JP | 9-45503 | A | 2/1997 |
| JP | 2002-283834 | A | 10/2002 |
| KR | 10-2005-0017366 | A | 2/2005 |
| KR | 10-2005-0018831 | A | 2/2005 |
| KR | 10-2005-0034998 | A | 4/2005 |
| KR | 10-2005-0094156 | A | 9/2005 |
| KR | 10-2005-0097808 | A | 10/2005 |
| KR | 10-0536909 | B1 | 12/2005 |
| KR | 10-2006-0038306 | A | 5/2006 |
| KR | 10-2007-0040110 | A | 4/2007 |
| KR | 10-0755091 | B1 | 9/2007 |

* cited by examiner

*Primary Examiner* — Samuel Gebremariam

(74) *Attorney, Agent, or Firm* — Morgan, Lewis & Bockius LLP

(57) ABSTRACT

A high-capacity positive temperature coefficient heater, may include a plurality of positive temperature coefficient rods, wherein each of the positive temperature coefficient rods has a built-in positive temperature coefficient element that generates heat when electric power is supplied thereto, a plurality of heat-radiating fins attached to either side of the positive temperature coefficient rods along a longitudinal direction thereof, an upper housing coupled to one ends of the positive temperature coefficient rods, and a lower housing coupled to the other ends of the positive temperature coefficient rods, wherein the heat radiating fins are bonded to the positive temperature coefficient rods by heat conductive adhesive.

8 Claims, 4 Drawing Sheets

HIGH-CAPACITY PTC HEATER

CROSS REFERENCE TO RELATED APPLICATION

The present application claims priority to Korean Patent Application Number 10-2008-0114251 filed on Nov. 17, 2008, the entire contents of which application is incorporated herein for all purposes by this reference.

BACKGROUND OF THE INVENTION

1. Field of the Invention

The present invention relates to a high-capacity Positive Temperature Coefficient (PTC) heater. More particularly, the present invention relates to a high-capacity PTC heater, in which heat-radiating fins are attached to either side of PTC rods by bonding to further improve heat transfer efficiency from the PTC rods to the heat-radiating fins, the heat-radiating fins bonded to the heat-radiating fins exclude a fixing device for fixing the heat-radiating fins in position to facilitate assembly and fabrication, the heat-radiating fins are formed as louver fins to increase a heat exchange area with the air, thereby improving overall heat exchange efficiency, and the thickness of the PTC rods is reduced and the width of the PTC rods and of the heat-radiating fins is increased to improve heat transfer and exchange efficiency, so that high-capacity output can be obtained.

2. Description of Related Art

A vehicle is equipped with an air conditioning system for selectively supplying cold and warm air to the inside thereof. In the summer season, an air conditioner is actuated to supply the cold air. In the winter season, a heater is actuated to supply the warm air.

In general, the heater is based on a heating system in which coolant heated by circulation through an engine exchanges heat with the air introduced by a fan, so that warmed air is supplied to the inside of the vehicle. This heating system has high energy efficiency because it uses the heat generated from the engine.

However, in the winter season, heating is not performed immediately after the engine is started since it takes some time until the engine is heated after being started. As such, the engine often idles for a predetermined time prior to moving the vehicle until the coolant is heated to a temperature suitable for the heating. This idling of the engine causes energy waste and environmental pollution.

In order to prevent this problem, there has been used a method of heating the interior of the vehicle using a separate pre-heater for a predetermined time when the engine is being warmed up. A conventional heater using a heating coil effectively performs the heating due to high heat generation, but has problems such as high fire danger and frequent repair and replacement of parts due to short lifetime of the heating coil.

Thus, a heater using a Positive Temperature Coefficient (PTC) element has recently been developed. This PTC heater has low fire danger, and can guarantee semi-permanent use due to long lifetime. For this reason, the coverage of the PTC heater becomes very wide. Further, the PTC heater used for a pre-heater generally has a relatively small capacity in view of its characteristics. Recently, there has been a tendency to develop a high-capacity PTC heater due to diversification of vehicles and user demand.

FIGS. 1 and 2 are schematic exploded perspective views illustrating the structure of a conventional PTC heater.

Referring to FIGS. 1 and 2, the conventional PTC heater includes a plurality of PTC rods 10 generating heat when electric power is supplied thereto, each of the PTC rods 10 having a built-in PTC element and an anode terminal 11 protruding from one end thereof; heat-radiating fin modules 20, which are in close contact with opposite sides of the respective PTC rods 10; cathode terminals 30 disposed in parallel between the neighboring heat-radiating fin modules 20; and upper and lower housings 40 and 50 coupled to opposite longitudinal ends of the PTC rods 10.

At this time, side frames 60 are mounted on left-hand and right-hand outer sides of the outermost heat-radiating fin modules 20 such that the PTC rods 10, heat-radiating fin modules 20 and cathode terminals 30, all of which are disposed parallel to one another, can be coupled in close contact with each other between the upper and lower housings 40 and 50. In detail, the side frames 60 are curved inwards, and are coupled to the upper and lower housings 40 and 50. The PTC rods 10, heat-radiating fin modules 20 and cathode terminals 30 are coupled in close contact with one another by means of an elastic contact force of the curved side frames 60. As a result, this coupling provides the entire structure of the PTC heater, which allows elasticity and heat to be efficiently transferred among the PTC rods 10, the heat-radiating fin modules 20 and the cathode terminals 30.

Meanwhile, as illustrated in FIG. 1, each heat-radiating fin module 20 is for increasing efficiency with which each PTC rod 10 exchanges heat with the air, and includes a heat-radiating fin 21 corrugated along the length so as to increase a contact area with the air, a case 22 fixedly holding the heat-radiating fin 21, and a cover 23 fastened to the case 22 by bolts 24 so as to close an open side of the case 22. Here, in order to fix the heat-radiating fin 21 as a component for substantially improving the heat-exchange efficiency, the case 22 and the cover 23 are separately prepared such that the heat-radiating fin 21 is not separated or moving from the PTC rod 10.

Thus, each heat-radiating fin module 20 is complicated when manufactured and increases the number of parts since the case 22 and cover 23 are additionally required to fix the heat-radiating fin 21. In order to solve this problem, the method of manufacturing the PTC heater is changed. For example, as illustrated in FIG. 2, a method of manufacturing each heat-radiating fin module 20' using a simple fin guide 25 and heat-radiating fin 21 has been developed. In this method, the heat-radiating fin module 20' also requires the fin guide 25 to fix the heat-radiating fin 21, and the fin guide 25 is configured such that opposite longitudinal edges thereof are bent into flanges 25*a*. Although this structure can be regarded to be simpler than that of FIG. 1, the heat-radiating fin module 20' still suffers from a complicated manufacturing process and a large number of parts.

Further, since the separate part such as the case 22 or the fin guide 25 is interposed between the heat-radiating fin 21 and the PTC rod 10, heat transfer efficiency from the PTC rod 10 to the heat-radiating fin 21 is lowered. Therefore, this type of heater is not suitable for the high-capacity PTC heater in terms of efficiency.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a high-capacity Positive Temperature Coefficient (PTC) heater, in which heat-radiating fins are attached to either side of PTC rods by bonding to further improve heat transfer efficiency from the PTC rods to the heat-radiating fins, the heat-radiating fins bonded to the heat-radiating fins exclude a fixing device for fixing the heat-radiating fins in position to facilitate assembly and fabrication, the heat-radiating fins are formed as louver fins to increase a heat exchange area with the air, thereby improving overall heat exchange efficiency, and the thickness of the PTC rods is reduced and the width of the PTC rods and of the heat-radiating fins is increased to improve heat transfer and exchange efficiency, so that high-capacity output can be obtained.

In an aspect of the present invention, the high-capacity positive temperature coefficient heater, may include a plurality of positive temperature coefficient rods, wherein each of the positive temperature coefficient rods has a built-in positive temperature coefficient element that generates heat when electric power is supplied thereto, a plurality of heat-radiating fins attached to either side of the positive temperature coefficient rods along a longitudinal direction thereof, an upper housing coupled to one ends of the positive temperature coefficient rods, and a lower housing coupled to the other ends of the positive temperature coefficient rods, wherein the heat radiating fins are bonded to the positive temperature coefficient rods by heat conductive adhesive.

The adhesive my include silicone adhesive.

Each of the heat-radiating fins may include a louver fin with louvers extending in a direction perpendicular to passage of air.

In another aspect of the present invention, the high-capacity positive temperature coefficient heater may further include flat separator plates, wherein each of the separator plates is interposed between two adjacent ones of the heat-radiating fins to space the adjacent heat-radiating fins apart from each other, wherein the separator plates are fixedly mounted to the upper or lower housing.

In still another aspect of the present invention, the high-capacity positive temperature coefficient heater may further include a printed circuit board mounted inside the upper housing, wherein anode and cathode terminals of the positive temperature coefficient rods are electrically connected through the upper housing to the printed circuit board to energize the positive temperature coefficient rods.

The upper housing may be divided into a housing body and a housing cover mounted on the housing body to receive the printed circuit board therebetween and the anode and cathode terminals of the positive temperature coefficient rods are electrically connected through the housing body to the printed circuit board, wherein the cathode terminal includes one integral body that is in contact with outer surfaces of all the positive temperature coefficient rods to electrically connect the positive temperature coefficient rods to the printed circuit board.

A first and second side frames may be coupled to both distal ends of the upper and lower housing to receive the heat-radiating fins therebetween and the first and second side frames are flat.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
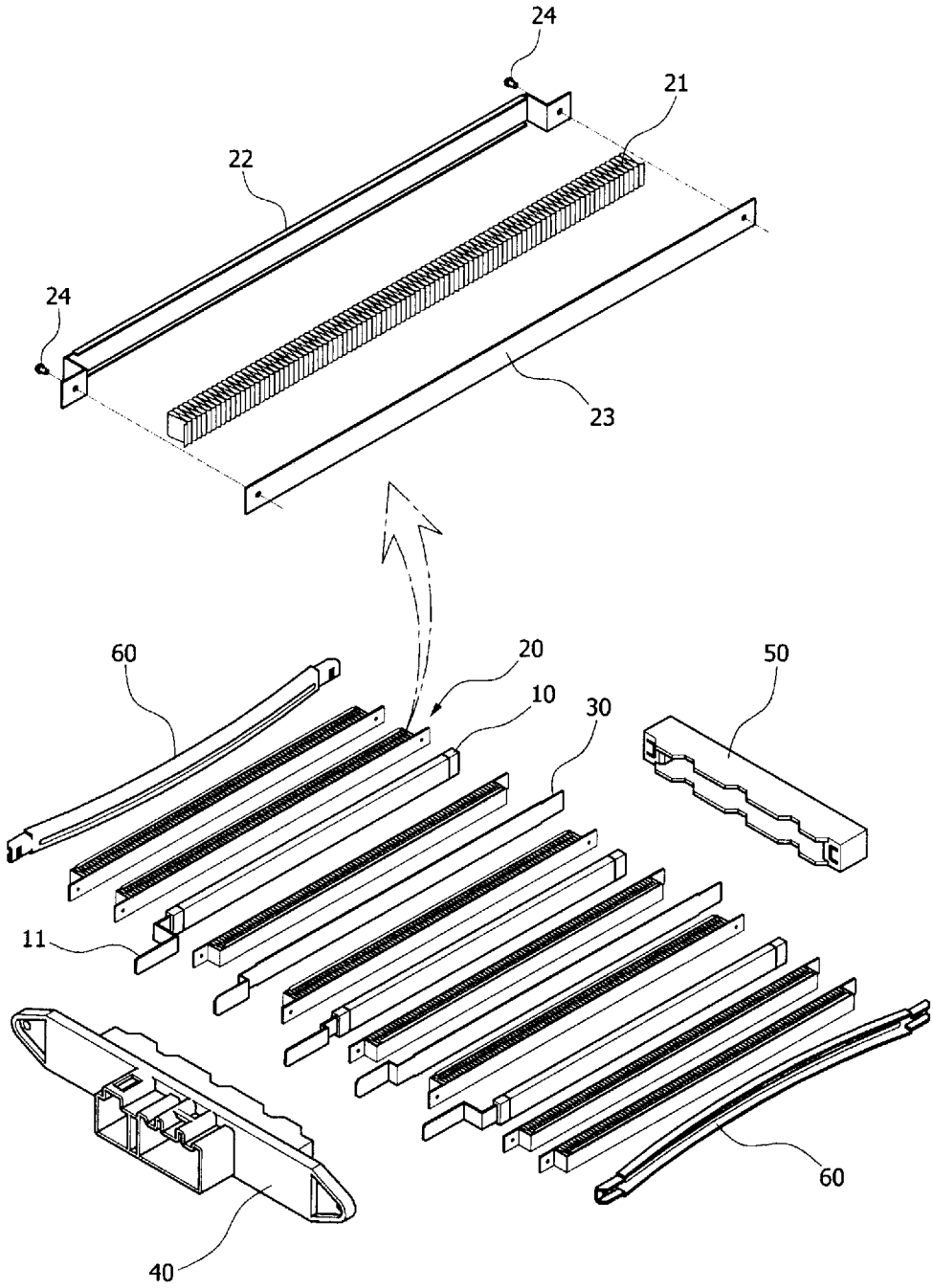
FIG.1 (Prior Art)
FIGS. 1 and 2 are schematic exploded perspective views illustrating the structure of a conventional PTC heater.
Figure 2:
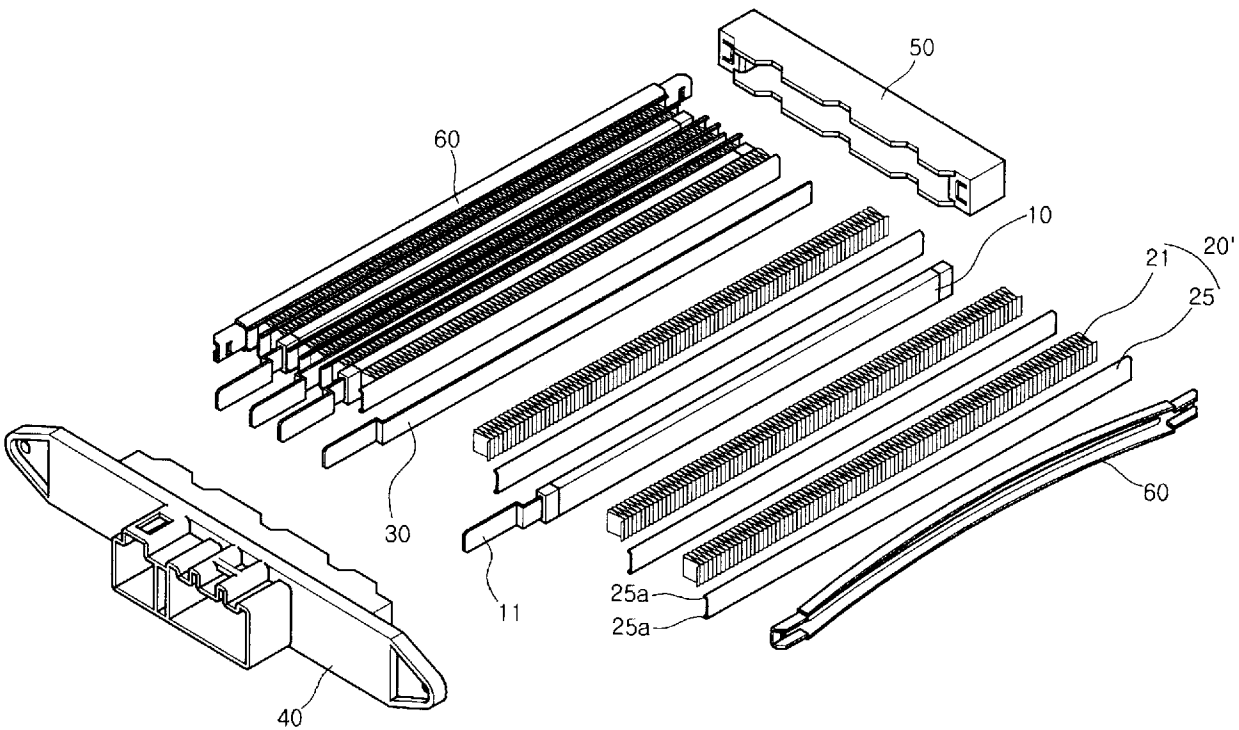
FIG.2 (Prior Art)

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 3:
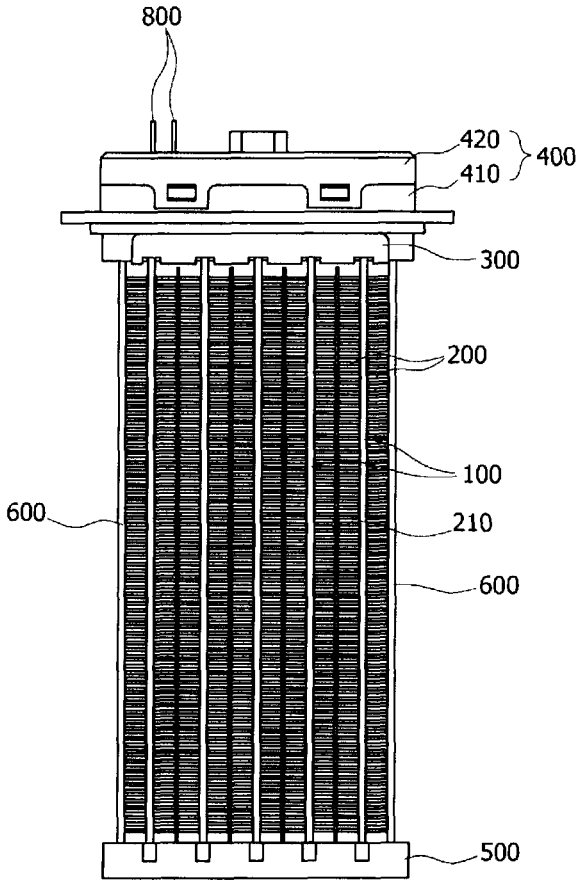
FIG. 3 is a front elevational view illustrating the structure of a high-capacity PTC heater according to an exemplary embodiment of the present invention.
Figure 4:
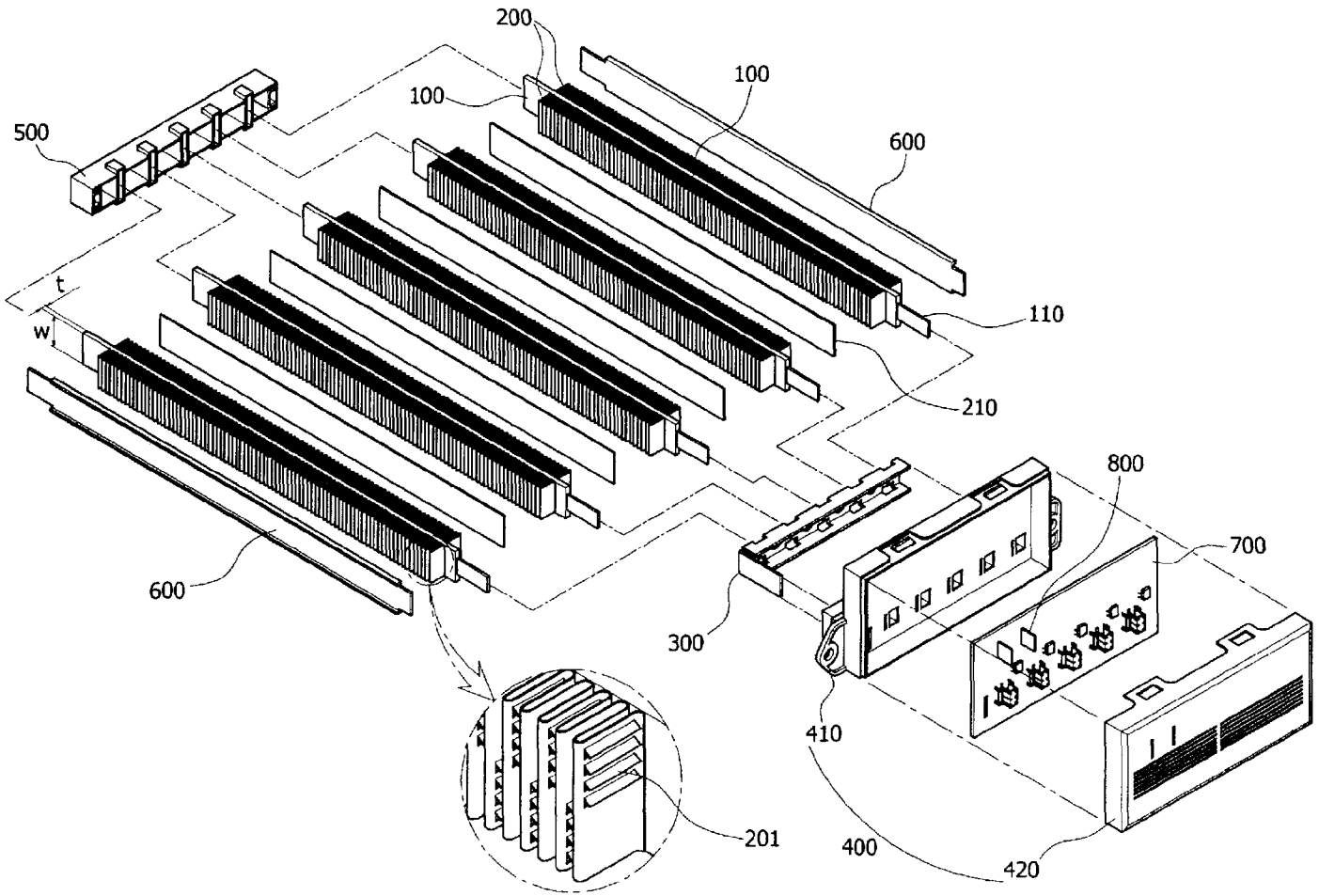
FIG. 4 is a schematic exploded perspective view illustrating the structure of the high-capacity PTC heater shown in FIG. 4.

FIG. 3 is a front elevational view illustrating the structure of a high-capacity PTC heater according to an exemplary embodiment of the present invention, and FIG. 4 is a schematic exploded perspective view illustrating the structure of the high-capacity PTC heater shown in FIG. 4.

Referring to FIGS. 3 and 4, the high-capacity Positive Temperature Coefficient (PTC) heater according to an exemplary embodiment of the present invention includes a plurality of PTC rods 100 arranged in parallel, each of the PTC rods 100 having built-in PTC elements (not shown) that generate heat when electric power is applied thereto; and heat-radiating fins 200 attached to either side of the PTC rods 100. An upper housing 400 is coupled to the upper end (i.e., the left end in the figures) of an assembly of the PTC rods 100, and a lower housing 500 is coupled to the lower end (i.e., the right end in the figures) of the assembly of the PTC rods 100. In addition, a first side frame 600 (i.e., a right side frame 600 in the figures) is coupled to the right ends of the upper and lower housings 400 and 500 and a second side frame 600 (e.g., a left side frame 600 in the figure) is coupled to the left ends of the upper and lower housings 400 and 500. In this manner, the upper and lower housings 400 and 500 and the side frames 600 form a frame structure of the PTC heater.

As shown in FIGS. 3 and 4, two heat-radiating fins 200 are attached to either side of one PTC rod 100 without a fixing device. In one exemplary embodiment of the present invention, the heat-radiating fins 200 can be bonded to the either side of the PTC rod 100 by heat conductive adhesive. More specifically, the adhesive can be silicone adhesive.

Since the heat-radiating fins 200 are directly bonded to the PTC rod 100 without a fixing device such as a case, heat transfer from the PTC rods 100 to the heat-radiating fins 200 can be improved. Further, the high-capacity PTC heater according to exemplary embodiment of the present invention can be easily fabricated due to a reduced number of parts.

In an exemplary embodiment of the present invention, each of the heat-radiating fins 200 can be corrugated along the length thereof. As shown in FIG. 4, the heat-radiating fin 200 can be a louver fin with louvers 201 for controlling the flow of the air, wherein the louvers 201 extend in a direction perpendicular to the passage of the air. Thus, the louvers 210 further increase the heat conduction area of the heat-radiating fin 200, which performs heat exchange with the air passing through the heat-radiating fin 200, to further increase heat exchange efficiency of the heat-radiating fin 200 and thereby improve the overall efficiency of the PTC heater.

A flat separator plate 210 can be interposed between two adjacent heat-radiating fins 200, which are arranged in parallel to each other. Unlike the related art, the separator plate 210 functions only to space the adjacent heat-radiating fins 200 apart from each other but does not fix the heat-radiating fins 200 in position. Thus, it is not required to form flanges on opposite longitudinal edges of the separator plate 210 to fix the heat-radiating fins 200. As a result, the separator plate 210 can be formed with a simple flat structure. Since the separator plate 210 functions only to space the adjacent heat-radiating fins 200 apart from each other, it can be mounted with a small amount of fixing force. Accordingly, the separator plate 210 can be configured with a simpler structure and be easily mounted on only one of the upper housing 400 and the lower housing 500 instead of being mounted on both the upper housing 400 and the lower housing 500.

Since the heat-radiating fins 200 are fixedly bonded to the PTC rod 100 in an exemplary embodiment of the invention, an elastic contact force generated from the side frames 600 is not required unlike the related art. Thus, the side frames 600 can be configured with a simpler flat plate instead of a curved shape of the related art, such that it can simply function as a frame. Since the side frames 600 in one exemplary embodiment of the invention is not required to have the elastic contact force resulting from the curved shape, a simple linear shape is applicable to the side frames 600 to thereby further facilitate fabrication.

In an exemplary embodiment of the present invention, the upper housing 400 can be divided into a housing body 410 and a housing cover 420. As shown in FIG. 4, a Printed Circuit Board (PCB) 700 for controlling the operation of the PTC rods 100 can be mounted inside the upper housing 400 in order to provide high-capacity performance. To control the operation of a plurality of the PTC rods 100, electronic components such as a power terminal 800 and a power transistor (not shown) can be mounted on the PCB 700, and anode terminals 110 and a cathode terminal 300 of the PTC rods 100 can be electrically connected to the PCB 700. With the above-described construction, the high-capacity PTC heater according to an exemplary embodiment of the present invention can be controlled by the PCB 700 that supplies electric power to the PTC rod 100 through the anode terminals 110 and the cathode terminal 300 according to a control mode such as Pulse Width Modulation (PWM).

In this case, the anode terminals 110 of the PTC rods 100 can be placed inside the PTC rods 100, with one end portion thereof protruding from one end of the PTC rods 100, respectively. As shown in FIGS. 3 and 4, the cathode terminal 300 can be formed as one integral body that is in contact with outer surfaces of all the PTC rods 100 to electrically connect the PTC rods 100 to the PCB 700. When electric power is supplied to the PCB 700 via the power terminal 800, electronic components such as a power transistor on the PCB 700 controls electric current flowing along the circuit of the PCB 700, and then the controlled electric current is delivered to the anode terminals 110 of the PTC rods 100. The electric current delivered to the anode terminals 110 of the PTC rods 100 causes the PTC elements (not shown) inside the PTC rods 100 to generate heat, and then flows out to the cathode 300 through the outer surfaces of the PTC rods 100.

Describing the construction of the PTC rods 100 in brief, each of the PTC rods 100 includes a pipe-shaped cover forming an outline of the PTC rod 100, an anode terminal 110 placed inside the cover of the PTC rod 100, with one end of thereof protruding from one end of the cover of the PTC rod 100, PTC elements placed inside the cover of the PTC rod 100 to be in contact with the anode terminal 110, and an insulator (not shown) electrically insulating the anode terminal 110 from the cover. With this construction, when electric current is supplied through the anode terminal 110, the PTC elements generate heat while the electric current is flowing through the PTC elements to the cover. This structure of the PTC elements can be modified in various forms.

In a typical PTC heater, the PTC rod is generally fabricated with a thickness 1.2 mm, and the PTC rod and the heat-radiating fin are generally fabricated with a width 10 mm. However, in the high-capacity PTC heater according to a exemplary embodiment of the present invention, the PTC rod 100 can be fabricated with a thickness t reduced to 0.8 mm in order to improve heat transfer efficiency of heat from the inner PTC elements, and the PTC rod 100 and the heat-radiating fin 200 can be fabricated with a width w increased to 16 mm in order to increase a contact area and thereby to enhance heat exchange with the air passing through the heat-radiating fin 200.

For convenience in explanation and accurate definition in the appended claims, the terms "upper", "lower", "left", "right", and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the claims appended hereto and their equivalents.

What is claimed is:

1. A high-capacity positive temperature coefficient heater, comprising:

a plurality of positive temperature coefficient rods, wherein each of the positive temperature coefficient rods has a built-in positive temperature coefficient element that generates heat when electric power is supplied thereto;

a plurality of heat-radiating fins attached to either side of the positive temperature coefficient rods along a longitudinal direction thereof;

an upper housing coupled to one ends of the positive temperature coefficient rods;

a lower housing coupled to the other ends of the positive temperature coefficient rods, wherein the heat radiating fins are bonded to the positive temperature coefficient rods by heat conductive adhesive; and flat separator plates, wherein each of the separator plates is interposed between two adjacent ones of the heat-radiating fins to space the adjacent heat-radiating fins apart from each other, and wherein the separator plates are not fixed to the heat-radiating fins.

2. The high-capacity positive temperature coefficient heater according to claim 1, wherein the adhesive comprises silicone adhesive.

3. The high-capacity positive temperature coefficient heater according to claim 1, wherein each of the heat-radiating fins comprises a louver fin with louvers extending in a direction perpendicular to passage of air.

4. The high-capacity positive temperature coefficient heater according to claim 1, wherein the separator plates are fixedly mounted to the upper or lower housing.

5. The high-capacity positive temperature coefficient heater according to claim 1, wherein a first and second side frames are coupled to both distal ends of the upper and lower housing to receive the heat-radiating fins therebetween and the first and second side frames are flat.

6. The high-capacity positive temperature coefficient heater according to claim 1, further comprising a printed circuit board mounted inside the upper housing, wherein anode and cathode terminals of the positive temperature coefficient rods are electrically connected through the upper housing to the printed circuit board to energize the positive temperature coefficient rods.

7. The high-capacity positive temperature coefficient heater according to claim 6, wherein the upper housing is divided into a housing body and a housing cover mounted. on the housing body to receive the printed circuit board therebetween and the anode and cathode terminals of the positive temperature coefficient rods are electrically connected through the housing body to the printed circuit board.

8. The high-capacity positive temperature coefficient heater according to claim 7, wherein the cathode terminal comprises one integral body that is in contact with outer surfaces of all the positive temperature coefficient rods to electrically connect the positive temperature coefficient rods to the printed circuit board.

* * * * *